US005700176A

United States Patent [19]

Potter

[11] Patent Number: 5,700,176

[45] Date of Patent: Dec. 23, 1997

[54] METHOD OF GETTERING AND SEALING AN EVACUATED CHAMBER OF A SUBSTRATE

[75] Inventor: Michael D. Potter, Grand Isle, Vt.

[73] Assignee: Advanced Vision Technologies, Inc., Rochester, N.Y.

[21] Appl. No.: 735,042

[22] Filed: Oct. 22, 1996

Related U.S. Application Data

[62] Division of Ser. No. 459,033, Jun. 2, 1995, Pat. No. 5,618, 216.

[51] Int. Cl.[6] ..... H01J 9/40

[52] U.S. Cl. ..... 445/25; 445/41

[58] Field of Search ..... 445/24, 25, 41

[56] References Cited

U.S. PATENT DOCUMENTS

| | | | |
|---|---|---|---|
| 4,721,885 | 1/1988 | Brodie | 313/576 |
| 4,855,636 | 8/1989 | Busta et al. | 313/306 |
| 5,127,990 | 7/1992 | Pribat et al. | 156/644 |
| 5,141,459 | 8/1992 | Zimmerman | 445/24 |
| 5,144,191 | 9/1992 | Jones et al. | 313/309 |
| 5,203,731 | 4/1993 | Zimmerman | 445/24 |
| 5,233,263 | 8/1993 | Cronin et al. | 313/309 |
| 5,308,439 | 5/1994 | Cronin et al. | 156/656 |
| 5,374,868 | 12/1994 | Tjaden et al. | 313/310 |
| 5,386,172 | 1/1995 | Komatsu | 313/309 |
| 5,397,957 | 3/1995 | Zimmerman | 313/309 |

OTHER PUBLICATIONS

Busta "Vacuum Microelectronics—1992" parts of article dealing with macroencapsulation and gettering, J of Micromechanics and Microengineering 2(2), 1992 pp. 61–63.

J. E. Cronin et al. "Matrix Display Using Electron–Emission Devices" IBM Technical Disclosure Bulletin, vol. 32, No. 5B (Oct. 1989) pp. 239–240.

J. E. Cronin et al. "Field Emission Triode Integrated–Circuit Construction Method" IBM Technical Disclosure Bulletin, vol. 32, No. 5B (Oct. 1989) pp. 242–243.

Anonymous "Ionizable Gas Device Compatible with Integrated Circuit Device Size and Processing" reproduced from Research Disclosure No. 305 (Sep. 1989).

*Primary Examiner*—Kenneth J. Ramsey
*Attorney, Agent, or Firm*—Theodore R. Touw

[57] ABSTRACT

A fabrication process is disclosed using process steps (S1–S18) similar to those of semiconductor integrated circuit fabrication to produce lateral-emitter field-emission devices and their arrays. In a preferred fabrication process for the simplified anode device, the following steps are performed: an anode film (70) is deposited; an insulator film (90) is deposited over the anode film; an ultra-thin conductive emitter film (100) is deposited over the insulator and patterned; a trench opening (160) is etched through the emitter and insulator, stopping at the anode film, thus forming and automatically aligning an emitting edge of the emitter; and means are provided for applying an electrical bias to the emitter and anode, sufficient to cause field emission of electrons from the emitting edge of the emitter to the anode. The anode film may comprise a phosphor (75) for a device specially adapted for use in a field emission display. The fabrication process may also include steps to deposit additional insulator films (130) and to deposit additional conductive films for control electrodes (140), which are automatically aligned with the emitter blade edge or tip (110). A fabrication process for forming an evacuated or gas-filled sealed chamber in a substrate is disclosed.

29 Claims, 5 Drawing Sheets

| |
|---|
| FIG. 4a |
| FIG. 4b |

| FIG. 5a |
| --- |
| FIG. 5b |

METHOD OF GETTERING AND SEALING AN EVACUATED CHAMBER OF A SUBSTRATE

This application is a division of application Ser. No. 08/459,033, filed Jun. 2, 1995, now U.S. Pat. No. 5,618,216.

This application is related to another application by Michael D. Potter titled "Lateral-Emitter Field-Emission Device With Simplified Anode," filed in the United States Patent and Trademark Office on the same date as this application.

FIELD OF THE INVENTION

This invention relates in general to integrated field-emission microelectronic devices and relates more particularly to lateral-emitter field-emission devices having a simplified anode construction especially adapted for use in field-emission displays and to simplified methods of fabricating such microelectronic devices.

BACKGROUND OF THE INVENTION

Field-emission displays are considered an attractive alternative and replacement for liquid-crystal displays, because of their lower manufacturing cost and lower complexity, lower power consumption, higher brightness, and improved range of viewing angles. Microelectronic field-emission devices more generally are also attractive alternatives to semiconductor devices for many applications, being capable of high performance and being capable of fabrication from a wide range of materials with less stringent controls of material purity, but with fabrication processes and equipment similar to those used for semiconductor fabrication. A review article on the general subject of vacuum microelectronics was published in 1992: Heinz H. Busta "Vacuum Microelectronics—1992," in Journal of Micromechanics and Microengineering, Vol. 2, No. 2 (June 1992). An article by Katherine Derbyshire, "Beyond AMLCDs: Field Emission Displays?" in Solid State Technology, Vol. 37 No. 11 (November 1994) pages 55–65, summarized fabrication methods and principles of operation of some of the competing designs for field-emission devices and discussed some applications of field-emission devices to flat-panel displays. The theory of cold field emission of electrons from metals is discussed in many textbooks and monographs, including the monograph by R. O. Jenkins and W. G. Trodden, "Electron and Ion Emission From Solids" (Dover Publications, Inc., New York, N.Y., 1965), Chapter 4.

Notations and Nomenclature

The terms emitter and cathode are used interchangeably throughout this specification to mean a field-emission cathode. The term "control electrode" is used herein to denote an electrode that is analogous in function to the control grid in a vacuum-tube triode. Such electrodes have also been called "gates" in the field-emission device related art literature. Ohmic contact is used herein to denote an electrical contact that is non-rectifying. Phosphor is used in this specification to mean a material characterized by cathodoluminescence. In descriptions of phosphors, a conventional notation is used wherein the chemical formula for a host or matrix compound is given first, followed by a colon and the formula for an activator (an impurity that activates the host crystal to luminesce), as in ZnS:Mn, where zinc sulfide is the host and manganese is the activator.

DESCRIPTION OF THE RELATED ART

Microelectronic devices using field emission of electrons from cold-cathode emitters have been developed for various purposes to exploit their many advantages including high-speed switching, insensitivity to temperature variations and radiation, low power consumption, etc. Most of the microelectronic field-emission devices in the related art have had emitters which point orthogonally to the substrate, generally away from the substrate, but sometimes toward the substrate. Examples of this type of device are shown, for example, in U.S. Pat. No. 3,789,471 by Spindt et al., U.S. Pat. No. 4,721,885 by Brodie, U.S. Pat. No. 5,127,990 by Pribat et al., U.S. Pat. Nos. 5,141,459 and 5,203,731 by Zimmerman, and in the above-mentioned article by Derbyshire. In such structures, the anode is typically a transparent faceplate parallel to the substrate and carrying a phosphor which produces the display's light output by cathodoluminescence. A few cold-cathode microelectronic devices have had field emitters oriented in a plane substantially parallel to their substrates, as for example in U.S. Pat. No. 4,728,851 by Lambe, U.S. Pat. No. 4,827,177 by Lee et al., and U.S. Pat. Nos. 5,233,263 and 5,308,439 by Cronin et al. The terminology "lateral field emission" and "lateral cathode" or "lateral emitter" of the latter two patents by Cronin et al. will be adopted herein to refer to a structure in which the field emitter tip or blade edge points in a lateral direction, i.e. substantially parallel to the substrate. In such lateral cathode structures of the prior art the anode is oriented substantially orthogonally to the substrate and to the emitter (as in U.S. Pat. Nos. 5,233,263 and 5,308,439 by Cronin et al.), or is coplanar with the emitter (as in U.S. Pat. No. 4,827,177 by Lee et al.), or requires a transparent substrate (as in U.S. Pat. No. 4,728,851 by Lambe). Some device structures and fabrication processes using lateral cathode configurations have been found to have distinct advantages, such as extremely fine cathode edges or tips and precise control of the inter-element dimensions, alignments, capacitances, and of the required bias voltages.

Problems Solved by the Invention

If lateral field-emission devices are used in a display cell with phosphor-coated anodes, a number of problems occur. In some of the prior art structures, the cathodoluminescence occurs only at a very narrow region at an edge of the anode facing the lateral emitter. In others the light emitted from the phosphor can be obscured by opaque electrodes or absorbed in the phosphor layer itself or in a faceplate. In some prior art structures very high anode voltages must be used. For low voltage electron field-emission device display elements (e.g. with anode potentials of less than about 10 volts with respect to the emitter), the actual electron penetration into the phosphor is on the order of 1 nanometer. Therefore, in displays using prior art lateral electron field-emission device display elements, the light emission due to cathodoluminescence occurs along the edge of the phosphor facing the emitter element. Furthermore, other electron field-emission displays such as the Spindt type (described in the patent by Spindt et al. and in the review article by H. H. Busta cited herein above) typically emit light at a phosphor surface which is opposite the phosphor surface facing the observer.

The device structure described herein has a lateral electron emitter situated a distance above the anode phosphor. With an appropriate applied bias, the emitted electrons spread out over the top surface of the phosphor and impinge over a wider area of the phosphor element than with other lateral electron field-emission device display elements. Hence, with this new structure, the light is emitted in direct view of the observer and is not attenuated by passing through the phosphor as is the case with prior art structures. Also, the light is generated over a larger portion of the cell area than in prior art structures. The prior art descriptions of lateral-emitter field-emission display elements do not show how to provide a bias voltage contact to the phosphor of such an anode element. The new structure described herein has a metal anode contact situated below the phosphor ("buried") and also may have means for connecting to that buried contact from the surface for applying electrical bias.

While the lateral-emitter type of construction has the distinct advantages described above, those lateral-emitter field-emission devices heretofore available having the most precise control of inter-element dimensions and alignment have been somewhat expensive to fabricate because of the relatively large number of materials and process steps used. Those process steps have included steps using conformal layers of sacrificial materials needed to form spacers that define some of the dimensions. The present invention eliminates some of the materials and process steps needed for fabrication, thus reducing fabrication time and cost and also providing a simplified anode structure, while retaining the advantages of lateral cathode construction and inherently automatic alignment of the lateral cathode type of design. This simpler structure and simpler, less expensive fabrication are effective both for field-effect devices having phosphor anodes used for display elements and for field-effect devices without phosphor. Thus the present invention solves several problems existing in the prior art.

Objects and Advantages of the Invention

An important object of the invention is providing a display with improved light emission from each cell of the display. A related object is a field-emission device structure specially adapted for use in a display cell. Another related object is a field-emission display which allows light emitted from a phosphor to be aimed more directly toward the viewer of the display. Another related object is a field-emission display cell structure in which the light emission area occupies a larger portion of the cell area than in prior art devices of the lateral-emitter type. Another object of the invention is a metallization structure that allows the other features and advantages of an improved lateral-emitter field-emission display device to be realized. A particular object is an anode electrical contact structure that does not obscure any portion of a phosphor surface of a display cell. A related object is an anode contact that can act as a mirror to reflect emitted light toward the observer of the display. Another object is a display cell anode structure that provides improved performance with coulombic aging of the phosphor thereby being reduced or eliminated. Another particular object is a display cell simplified by having a control electrode configuration that may be made with a single metallization step. An overall object of the invention is an improved display which nevertheless retains all the known advantages of lateral-emitter field-emission devices, including the following: extremely fine cathode edges or tips; exact control of the cathode-to-anode distance (to reduce device operating voltage and to reduce device-to-device variability); exact control of the cathode-to-control-electrode distance (to control the control-electrode-to-cathode overlap, and thereby control the inter-electrode capacitances and more precisely control the required bias voltage); inherent alignment of the control-electrode and cathode structures; self-alignment of the anode structure to the control-electrode and cathode; and improved layout density. Another object of the invention related to retaining known advantages of lateral-emitter field-emission devices is the significant design flexibility provided by an integrated structure which reduces the number of interconnections between devices, thus reducing costs and increasing device reliability and performance. Another important object of the invention is a process using existing microelectronic fabrication techniques and apparatus for making integrated lateral-emitter field-emission display device cell structures with economical yield and with precise control and reproducibility of device dimensions and alignments. A major object of the invention is a simplified anode structure for lateral-emitter field-emission devices. Another major object of the invention is a fabrication process which eliminates some masks otherwise needed for fabrication of a self-aligned lateral-emitter field-emission device, thus reducing fabrication time and cost.

SUMMARY OF THE INVENTION

In one aspect of the invention, a field-emission device is made with a lateral emitter substantially parallel to a substrate and with a simplified anode structure. The lateral-emitter field-emission device has a thin-film emitter cathode which has a thickness of not more than several hundred angstroms and has an emitting blade edge or tip having a small radius of curvature. The simplified anode device may also have one or more control electrodes. The anode's top surface is precisely spaced apart from the plane of the lateral emitter and receives electrons emitted by field emission from the blade edge or tip of the lateral-emitter cathode, when a suitable bias voltage is applied. The device may be configured as a diode, or as a triode, tetrode, etc. having one or more control electrodes positioned to allow control of current from the emitter to the anode by an electrical signal applied to the control electrode. In a particularly simple embodiment, a single control electrode is positioned in a plane above or below the emitter edge or tip and automatically aligned to that edge. The simplified devices are specially adapted for use in arrays, including field-emission display arrays.

In another aspect of the invention, a novel fabrication process using process steps similar to those of semiconductor integrated circuit fabrication is used to produce the novel devices and their arrays. Various embodiments of the fabrication process allow the use of conductive or insulating substrates and allow fabrication of devices having various functions and complexity. The anode is simply fabricated, without the use of prior art processes which formed a spacer made by a conformal coating. In a preferred fabrication process for the simplified anode device, the following steps are perfomed: an anode film is deposited; an insulator film is deposited over the anode film; an ultra-thin conductive emitter film is deposited over the insulator and patterned; a trench opening is etched through the emitter and insulator, stopping at the anode film, thus forming and automatically aligning an emitting edge of the emitter; and means are provided for applying an electrical bias to the emitter and anode, sufficient to cause field emission of electrons from the emitting edge of the emitter to the anode. The anode film may comprise a phosphor for a device specially adapted for use in a field-emission display. The fabrication process may also include steps to deposit additional insulator films and to deposit additional conductive films for control electrodes, which are automatically aligned with the emitter blade edge or tip.

DETAILED DESCRIPTION OF THE PREFERRED EMBODIMENTS

Figure 1:
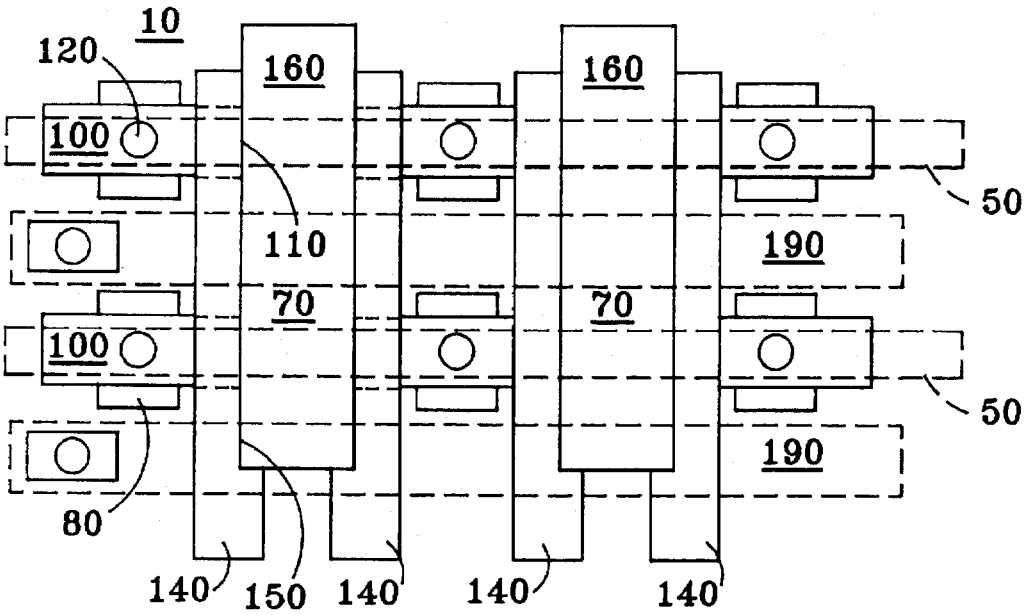
FIG. 1 shows a plan view of a portion of a preferred array embodiment of field-emission devices made in accordance with the invention.

FIG. 1 shows a plan view of a portion of a preferred array embodiment of field-emission devices made in accordance with the invention. In the simple array of FIG. 1, each field-emission device shares an anode with at least one other device, and each anode is shared by two or more devices. Some of the emitters in FIG. 1 are also shared by two devices. This sharing of elements between devices is not necessary for use or operation of the invention, but it is sometimes useful in designing and fabricating arrays with higher density (in terms of the number of devices per unit area). The basic features of devices made in accordance with the invention may be clearly understood by considering the single device of FIG. 2.

Figure 2:
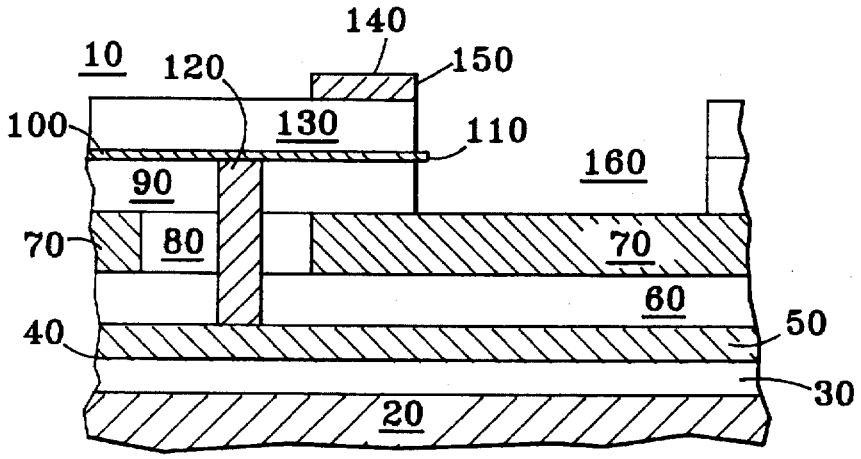
FIG. 2 shows a side elevation cross-sectional view of an embodiment of a single field-emission device made in accordance with the invention.

FIG. 2 shows a side elevation cross-sectional view of an embodiment of a single field-emission device made in accordance with the invention. The field-emission device, denoted generally by 10, is made on a flat substrate 20. A layer of insulator 30 has a top major surface, which defines a reference plane 40 convenient for description of other elements. A layer of conductive material 50 may be used as a buried contact layer. It should be noted that conductive layer 50 may lie on the reference plane, as shown in FIG. 2, or may be made by depositing conductive layer 50 into recesses formed in insulator 30 and by planarizing the resulting surface. In the latter case the top surface of conductive layer 50 lies in reference plane 40. A layer of insulator 60 is made on the reference plane 40, covering conductive layer 50. A conductive layer parallel to plane 40 serves as an anode 70. As will become apparent from a reading of the remainder of this specification and the appended claims, the preferred fabrication process described herein below automatically places the top surface of anode 70 below the plane of lateral emitter 100. For embodiments such as that of FIG. 2, in which some devices have independent anodes, the anodes of adjacent devices are separated and insulated from each other by regions of an insulator 80. At the left side of FIG. 2, a small portion of the anode 70 of an adjacent device is shown to the left of insulator 80; that portion is not involved in the structure or operation of the single device of the present description. An insulating layer 90 of predetermined thickness is made parallel to the substrate. An ultra-thin conductive layer which forms an emitter layer 100 is also made parallel to the substrate and patterned, thus forming a lateral emitter. A conductive contact 120 may connect emitter layer 100 to buried contact layer 50. If the device is to have a control electrode 140 above emitter 100, then two additional layers are made: a layer of insulator 130 and a conductive layer patterned to form a control electrode 140. In the fabrication process for this device (described more fully herein below), an opening 160 is provided by employing a directional etch. That opening extends through all the layers of conductors and/or insulators lying above the anode down to the top surface of anode 70. The process of etching opening 160 forms an blade edge or tip 110 where lateral-emitter thin film 100 terminates after the etch. The blade edge or tip 110 has a very small radius of curvature, limited by half the thickness of the ultra-thin lateral-emitter layer 100. Preferred thicknesses of lateral-emitter film 100 are less than about 300 ångstroms, which limit the radius of curvature of lateral-emitter blade edge or tip to be less than about 150 ångstroms. Those skilled in the art will recognize that the radius of curvature is a significant factor in producing an electric field at tip 110 sufficient to cause cold-cathode field emission at a low applied bias voltage, and that the radius of curvature may be somewhat less than half of the film thickness. Another factor significant in determining the electric field effective in causing field emission is the (predetermined) thickness of insulator film 90. The degree of film thickness control in conventional semiconductor integrated processing is sufficient to control the thickness of insulator film 90 to the desired precision. Devices made in accordance with the present invention may be operated at applied bias voltages of 10 to 50 volts or even less. In the preferred embodiment of FIG. 2, anode 70 extends at least partially under lateral emitter 100. That is, anode 70 extends beyond the vertical plane through emitting edge 110 defined by the side wall of opening 160.

It should be noted that conductive connections to the various electrodes of the device may be made in a conventional manner, and are therefore not shown in the drawings. These conductive connections may be made, for example, by vertical studs that lie outside the plane of the side elevation cross-section view of FIG. 2. For example, a conductive stud may extend from emitter 100 and/or buried contact layer 50 to a surface conductive pad to which the emitter bias voltage may be applied. A similar conductive connection, electrically isolated from the emitter connection, may be made to anode 70, for application of the anode bias voltage. Similarly, conductive connections are needed to apply control signals to control electrode(s) 140 if the device is a triode or tetrode, etc. having such control electrodes. The arrangement just described may also be reversed, in the sense that the emitter connection may be made directly to a surface pad, and buried contact layer 50 may be used for anode contacts. Of course, for field emission of electrons to occur, the polarity of applied bias voltages must be such that the anode is positive with respect to the emitter. Various devices made on the same substrate need not have identical physical arrangements of conductive connections. Some devices may have buffed anode contacts, while other devices on the same substrate may have buried emitter contacts. Such arrangements allow for compact and efficient circuit layout in circuits in which an emitter of one device is to be connected to an anode of another device. With such arrangements, dissimilar connections lying in the same plane and not intended to be connected may be kept electrically independent by being spaced laterally and/or by having intervening insulator material disposed between them, as is known in the art.

Figure 3:
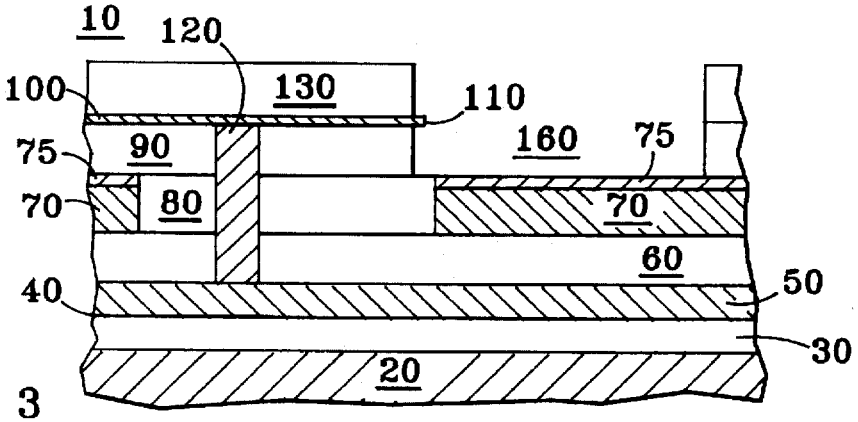
FIG. 3 shows a side elevation cross-sectional view of an alternate embodiment of a single field-emission device.

FIG. 3 shows a side elevation cross-sectional view of an alternate embodiment of a single field-emission device made in accordance with the invention. The lateral-emitter field-emission device of FIG. 3 is a diode device, without a control electrode. The anode of the device shown in FIG. 3, denoted generally by 70, includes a phosphor layer 75, which is a part of anode 70. If the anode phosphor is conductive, the entire anode 70 may consist of phosphor. The anode 70 of FIG. 3 is shown with a separately identified phosphor film 75 to illustrate an alternative embodiment.

The device of FIG. 3 also differs from FIG. 2 in that anode 70 does not extend beneath emitting blade edge or tip 110 of lateral emitter 100. Another way of describing the alternative structure shown in FIG. 3 is that opening 160, the sidewall of which defines the vertical plane containing emitting edge 110 of lateral emitter 100, extends beyond the horizontal extent of anode 70. However the vertical extent of opening 160 is still determined by the fact that opening 160 extends vertically only to the top surface of anode 70 (which in this embodiment is the top surface of phosphor film 75). The minimum vertical extent of opening 160 in the device of FIG. 3 is the sum of the predetermined thickness of insulator layer 90 and the predetermined thickness of lateral emitter 100. The field-emission device may be made with a plurality of anodes 70 (not shown in the drawings). A useful example of such a structure has three anodes per emitter, with a different phosphor color of each anode. A particularly useful combination is a three-anode device with red, green, and blue phosphors for an RGB display.

Operable and preferred materials for the various structural elements of the lateral-emitter field-effect device with simplified anode are described herein below in connection with an exposition of a novel and preferred fabrication process.

A novel fabrication process using process steps similar to those used in semiconductor integrated circuit fabrication may be used to produce the devices and their arrays in accordance with the invention. Various embodiments of the fabrication process allow the use of conductive or insulating substrates and allow fabrication of devices having various functions and complexity. A notable feature of all the fabrication process embodiments described herein is that the anode is simply formed without the use of a spacer employed in some prior art processes. (In those prior art processes, a spacer was formed by a sacrificial conformal coating.)

Figure 4A:
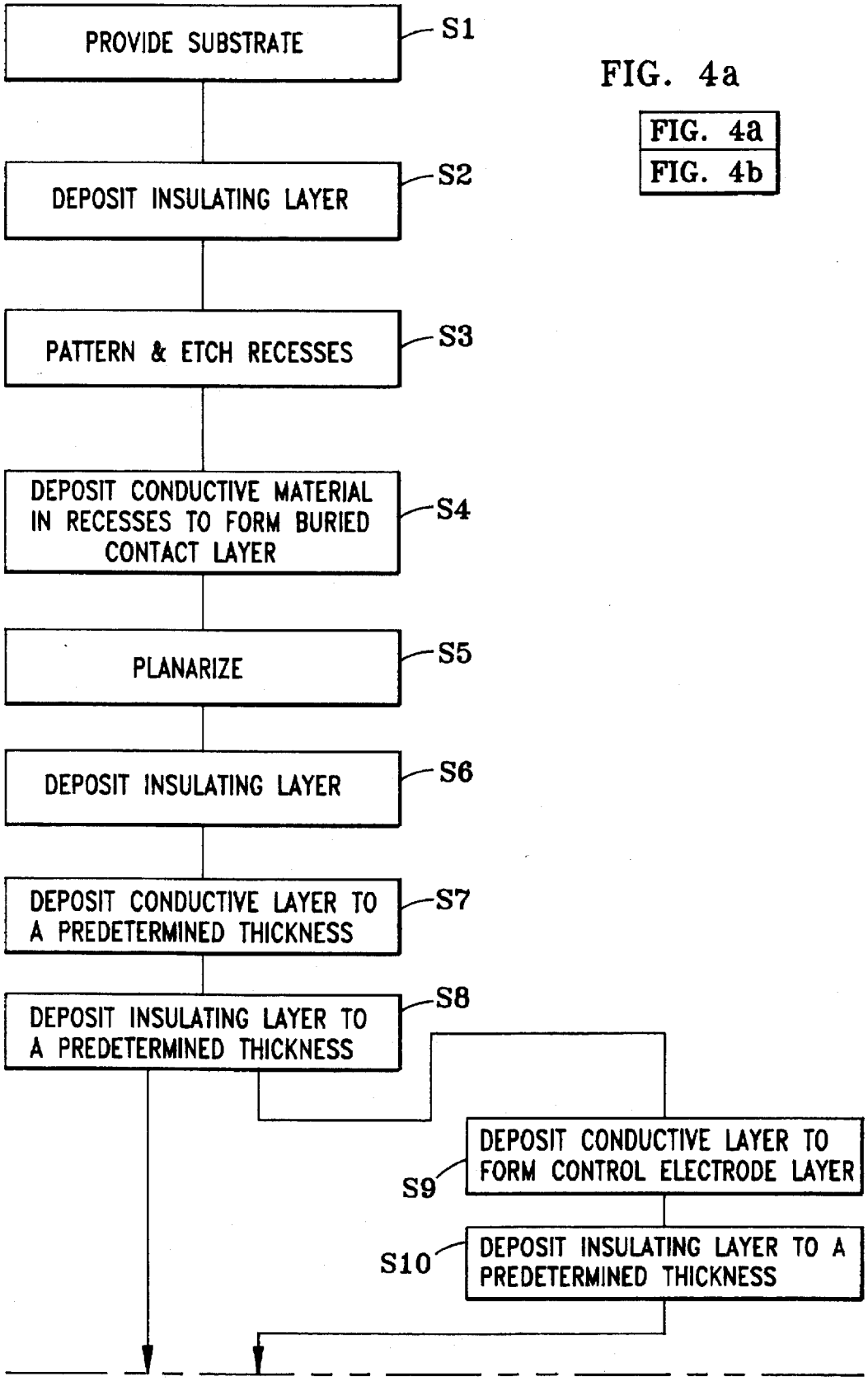
FIGS. 4*a* and 4*b* together show a flow diagram of an embodiment of a fabrication process performed in accordance with the invention.
Figure 4B:
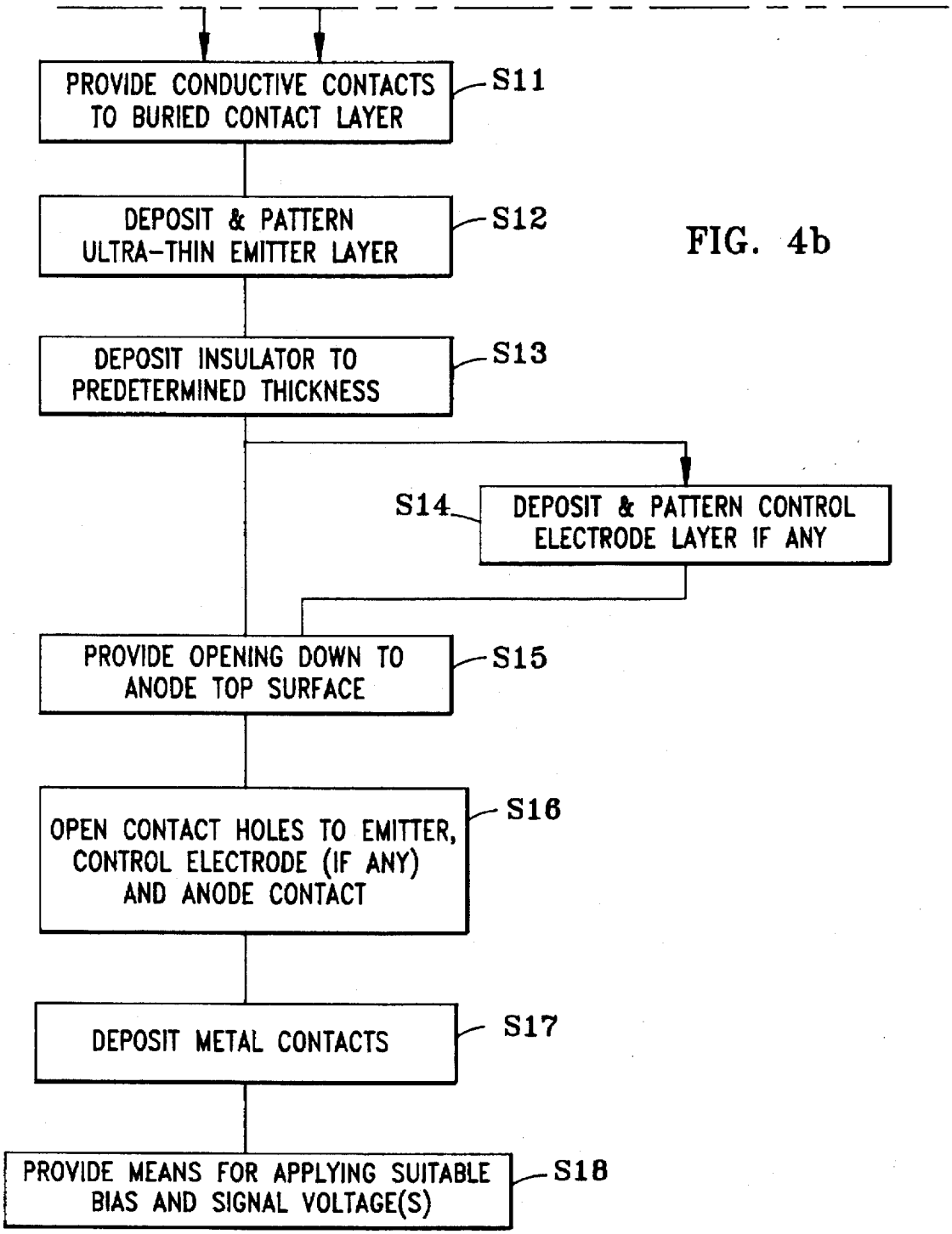
Figure 5A:
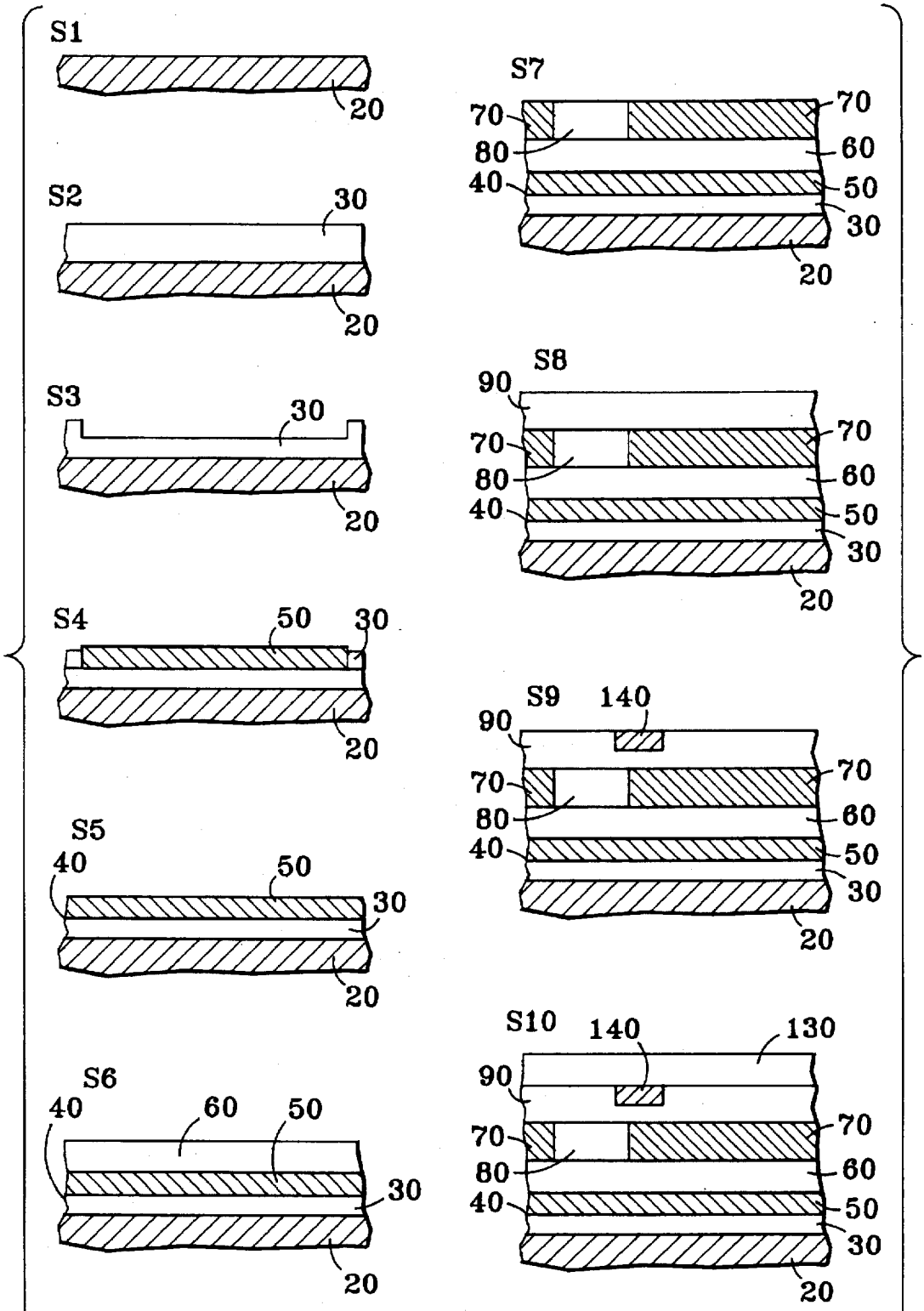
FIGS. 5*a* and 5*b* together show a series of side elevation cross sectional views corresponding to results of the process steps of FIGS. 4*a* and 4*b*.
Figure 5B:
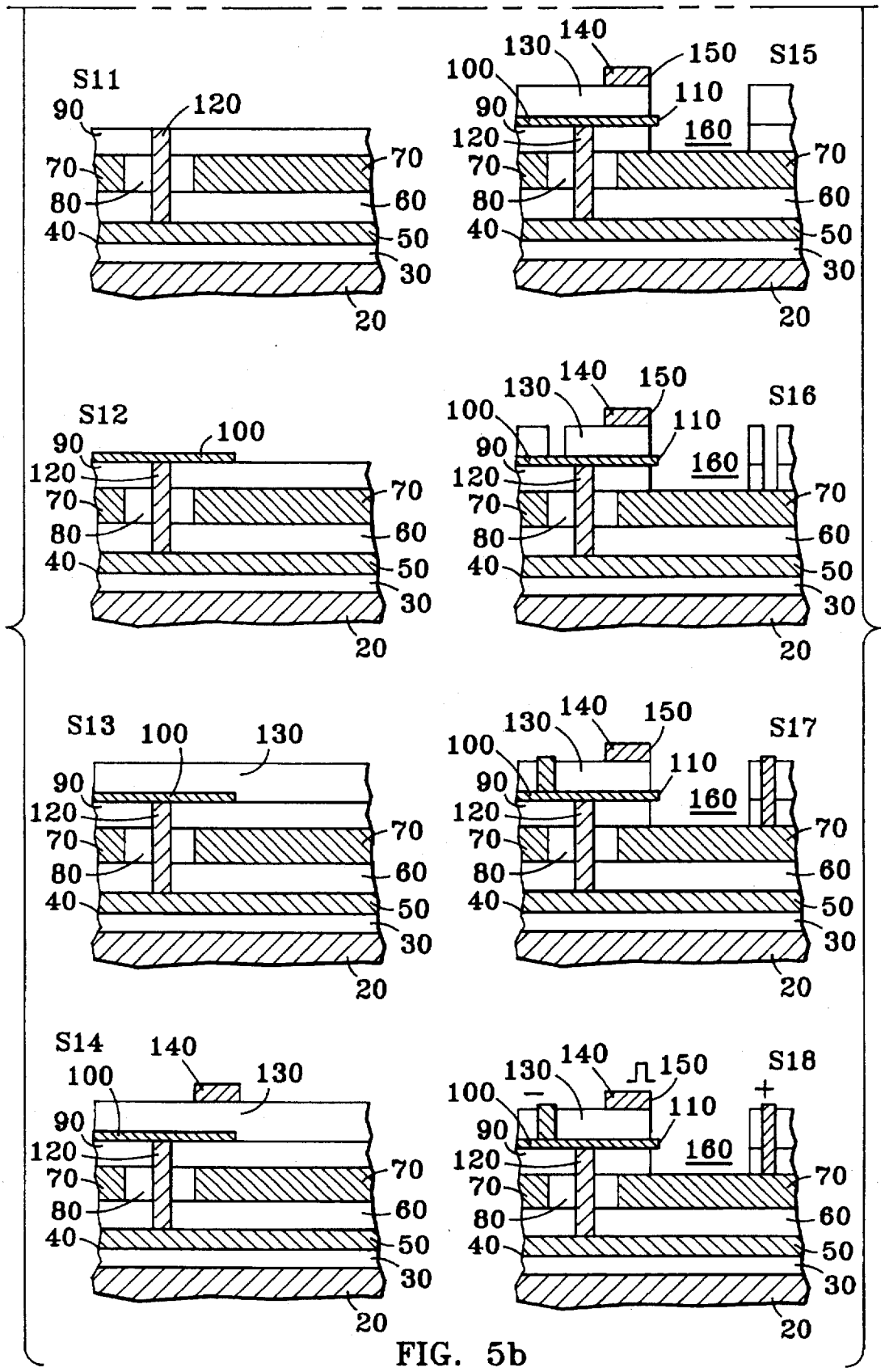

FIGS. 4*a* and 4*b* together show a flow diagram of an embodiment of a fabrication process performed in accordance with the invention. FIGS. 5*a* and 5*b* together show a series of side elevation cross sectional views corresponding to results of the process steps of FIGS. 4*a* and 4*b*. In the following description of a preferred process for fabricating field-emission devices, reference is made to FIGS. 4*a*, 4*b*, 5*a*, and 5*b*, in which the same or similar process steps and the device side elevation cross-sectional views of results corresponding to those steps are both denoted by the same step references S1, S2, . . . , S18. A simple overall process outline for fabrication of a diode device is described first, followed by a description of the detailed process which is depicted in FIGS. 4*a* and 4*b* and which is further illustrated by the corresponding results of FIGS. 5*a* and 5*b*.

In a simple fabrication process for a diode field-emission device with simplified anode, the following steps are performed: an anode film 70 is deposited (S7); an insulator film 90 is deposited (S8) over the anode film; an ultra-thin conductive emitter film 100 is deposited (S12) over the insulator and patterned; a trench opening 160 is etched (S15) through the emitter and insulator, stopping at the anode film, thus forming and automatically aligning an emitting edge 110 of the emitter; and means are provided (S18) for applying an electrical bias to the emitter and anode, sufficient to cause field emission of electrons from the emitting edge 110 of the emitter 100 to the anode 70. The anode film 70 deposited in step S7 may comprise a phosphor film 75 for a device specially adapted for use in a field-emission display. The phosphor may be any cathodoluminescent material, and may be selected on the basis of its conductivity and/or the color of its luminescence.

A fabrication process for a triode, tetrode, etc. device may also include steps to deposit additional insulator films 130 and to deposit additional conductive films 140 for control electrodes, which have a control electrode edge 150 automatically aligned with the emitter blade edge or tip 110. In the following detailed process description, these additional steps are included as "optional" steps, to be performed only if control electrodes are to be included in a particular device structure. It will be apparent to one skilled in the art that the detailed process of FIGS. 4*a* and 4*b*, illustrated by the results of FIGS. 5*a* and 5*b*, may be modified to fabricate simpler devices by omitting particular process steps as appropriate. Other variations in technique and in the order of process steps will also be apparent to one skilled in the art.

A detailed description of a preferred process for fabricating the field-emission devices now proceeds, with reference to FIGS. 4*a*, 4*b*, 5*a*, and 5*b*.

To fabricate a triode device with one or two control electrodes, the process illustrated in FIGS. 4*a*, 4*b*, 5*a* and 5*b* is performed. A substrate 20 is provided (step S1), which may be a silicon wafer. An insulating layer 30 is deposited (step S2) on the substrate. This may be done, for example, by growing a film of silicon oxide approximately one micrometer thick on a silicon substrate. A pattern is defined on the insulator surface for depositing a conductive material. In the preferred process, a pattern of recesses is defined and etched (step S3) into the surface of the insulator layer. In step S4, metal is deposited in the recesses to form a buried contact layer 50, which is then planarized (step S5). While this is described here as a metal deposition, the conductive material deposited in step S4 may be a metal such as aluminum, tungsten, titanium, etc., or may be a transparent conductor such as tin oxide, indium tin oxide etc. (For applications using a common emitter for all devices made on a substrate, the substrate may be conductive and perform the function of a buried emitter contact. For such applications, steps S2, S3, S4, and S5 may be omitted, although a step similar to step S2 may be required to insulate a control electrode if any from the substrate.) An insulating layer 60 is deposited (step S6). This may be a chemical vapor deposition of silicon oxide to a thickness of about 0.1 to 2 micrometers, for example.

A conductive layer is deposited (step S7) to a predetermined thickness and patterned to form an anode layer 70. If anode 70 is not required to be cathodoluminescent in order to function as a light source, then the conductive anode layer 70 deposited in step S7 may be a metal film or another conductive film such as indium oxide or indium tin oxide (ITO). If the device is to be used in a light-emitting application, such as a display, the conductive layer may be a conductive phosphor 75 or may be a composite layer comprising a conductive material with a thin film of phosphor 75 on its top surface. Suitable phosphors include zinc oxide(ZnO), zinc sulfide (ZnS) and many other compounds. Some other suitable phosphors are ZnO:Z; $SnO_2$:Eu; $ZnGa_2O_4$:Mn; $La_2O_2S$:Tb; $Y_2O_2S$:Eu; LaOBr:Tb; ZnS:Zn+$In_2O_3$; ZnS:Cu,Al+$In_2O_3$; (ZnCd)S:Ag+$In_2O_3$; and ZnS:Mn+$In_2O_3$. Still other suitable phosphor materials are described, for example, in the chapter by Takashi Hase et al. "Phosphor Materials for Cathode Ray Tubes" in "Advances in Electronics and Electron Physics" Vol. 79 (Academic Press, San Diego, Calif., 1990), pages 271–373, which reference also uses the conventional phosphor notation used here. If the application requires anode layer 70 to be patterned, that patterning may be done by subprocesses that are conventional in semiconductor fabrication practice, using lithography and etching to pattern the layer. In particular, anode layer 70 may be formed and patterned by a process analogous to steps S3, S4, and S5.

In the next step (S8), an insulating layer 90 is deposited to a precisely predetermined thickness. This predetermined thickness of insulating layer 90 is quite important in determining the emitter-to-anode closest distance, and thus in determining the electric field produced by a given applied bias voltage. Step S8 may comprise chemical vapor deposition of silicon oxide to a predetermined thickness in the range of 0.1 to 2 micrometers, for example.

Steps S9 and S10 are performed if a control electrode layer 140 is needed below the emitter layer 100. (Such a control electrode layer is shown in FIG. 5*a*, but then omitted from FIG. 5*b* to illustrate the option without a lower control electrode layer.) If needed, a conductive control electrode layer 140 is deposited and patterned in step S9. In step S10 an insulating layer 130 of a predetermined thickness is deposited over conductive control electrode layer 140 to insulate it and to provide a flat insulating surface parallel to the substrate for the next step. Whether or not steps S9 and S10 are performed, a planar insulating surface is provided.

This description of a fabrication process continues with reference to FIG. 4*b* and FIG. 5*b*, respectively showing the remaining fabrication steps and the corresponding side cross sectional views of the device. In step S11, conductive contacts 120 are provided to the buried contact layer 50, by opening suitable contact holes and depositing conductive material in them (forming "studs") to make ohmic contact with buried contact layer 50. In step S12, an ultra-thin emitter layer 100 is deposited and patterned. Preferred materials for conductive lateral-emitter layer 100 are titanium, tungsten, tantalum, molybdenum, or their alloys such as titanium-tungsten alloy. However, many other conductors may be used, such as aluminum, gold, silver, copper, copper-doped aluminum, platinum, palladium, polycrystalline silicon, etc. or transparent thin-film conductors such as tin oxide or indium tin oxide (ITO). It is very desirable to use a material with a low work function for electron emission. In this respect, preferred materials have work functions less than three electron volts, and even more preferred materials have work functions of less than one electron volt. The deposition in step S12 is controlled to form a film preferably of about 100–300 ångstroms thickness in order to have an emitter blade edge or tip 110 in the final structure that has a radius of curvature preferably less than 150 ångstroms and more preferably less than 50 ångstroms. To fabricate the preferred embodiment of FIG. 2, patterning of lateral emitter 100 is done so that lateral emitter 100 extends over at least a portion of anode 70. An insulator 130 is deposited (step S13) over the emitter layer. Again this may be a chemical vapor deposition of silicon oxide to a thickness of about 0.1 to 2 micrometers, for example. If there are to be two control electrodes and if symmetry with respect to the plane of emitter layer 100 is desired, then this insulator layer 130 should be made the same thickness as the insulator layer 130 deposited in step S10. If a control electrode 140 is to be incorporated, a conductive material is deposited and patterned (step S14) to form the upper control electrode layer 140. (The control electrode 140 may be deposited in a recess pattern and planarized, as in the case of the buried contact layer 50.) It should be mentioned that the conductive films deposited and patterned in steps S4, S9 (if performed), S12, and S14 (if performed) are all deposited in at least partial alignment with respect to the anode film 70 deposited and patterned in step S7.

In step S15, an opening is provided through all the layers lying over anode 70, down to the top surface of anode layer 70. This opening is patterned to intersect at least some portions of emitter layer 50 (and of control electrode layers 140 if any), to define emitting edge 110 of emitter layer 100 (and to define edge 150 of control electrode layer 140 if any). This step is performed by using conventional directional etching processes such as reactive ion etching sometimes called "trench etching" in the semiconductor fabrication literature. To fabricate the preferred embodiment of FIG. 2, step S15 is performed while leaving at least a portion of insulator 90 remaining and covering at least a portion of anode 70.

In step S16, contact holes are opened to emitter, control electrode, and anode if needed. Metal contacts are deposited where needed in step S17. Alternatively, this part of the process (steps S16 and S17) may be performed after step S13 or S14 but before S15. It that case, the sequence of process steps would be as follows: S13, S14 (if used), S16, S17, and then S15. It should be noted that for some display applications (such as so-called "heads-up" displays), it is desirable to form the device structure using substantially transparent materials for all the films. With the operable and preferred thicknesses of the films in the present invention, such transparent films may be made if desired.

In step S18, means are provided for applying suitable electrical bias voltages, and (for devices incorporating control electrodes) suitable signal voltages. Such means may include, for example, contact pads selectively provided at the device top surface to make electrical contact, and optionally may include wire bonds, means for tape automated bonding, flip-chip or C4 bonding, etc. In use of the device, of course, conventional power supplies and signal sources must be provided to supply the appropriate bias voltages and control signals. These will include providing sufficient voltage amplitude of the correct polarity (anode positive) to cause cold-cathode field emission of electron current from emitter edge 110 to anode 70. If desired, a passivation layer may be applied to the device top surface, except where there are conductive contact studs and/or contact pads needed to make electrical contacts. This completes the description of the detailed process illustrated in FIGS. 4*a*, 4*b*, 5*a* and 5*b*.

If it is desired to have the field-emission cell operating with a vacuum or a low pressure inert gas in opening 160, it is necessary to enclose that space or cavity. This can be done by a process similar to that described in the anonymous publication "Ionizable Gas Device Compatible with Integrated Circuit Device Size and Processing," publication 30510 in "Research Disclosure", Number 305, September 1989. Such a process can be begun by etching a small auxiliary opening, connected to the opening provided in step S15, but not as deep as that opening (i.e. not extending as deeply as the level of anode layer 70). This auxiliary opening may be made at a portion of the cavity spaced away from the emitter edge area. The opening for the main cavity and the connected auxiliary opening are both filled temporarily with a sacrificial organic material, such as parylene, and then planarized. An inorganic insulator is deposited, extending over the entire device surface including over the sacrificial material, to enclose the cavity. A hole is made in the inorganic insulator by reactive ion etching only over the auxiliary opening. The sacrificial organic material is removed from within the cavity by a plasma etch, such as an oxygen plasma etch, which operates through the hole. The atmosphere surrounding the device is then removed to evacuate the cavity. If an inert gas filler is desired, then that gas is introduced at the desired pressure. Then the hole and auxiliary opening are immediately filled by sputter-depositing an inorganic material to plug the hole. If introduction of a gettering material is desired, the hole-plugging step may consist of two or more substeps: viz. depositing a quantity of getter material, and then depositing an inorganic insulator to complete the plug. The plug of inorganic insulator seals the cavity and retains either the vacuum or any inert gas introduced. The gettering material, if used, is chosen to getter any undesired gases, such as oxygen or gases containing sulfur, for example. Some suitable getter materials are Ca, Ba, Ti, alloys of Th, etc. or other conventional getter materials known in the art of vacuum tube construction. This process for retaining vacuum or gas atmospheres is not illustrated in FIGS. *4a*, *4b*, *5a*, and *5b*.

It will be appreciated by those skilled in the art that integrated arrays of field-emission devices, such as the array of FIG. 1, may be made by simultaneously performing each step of the fabrication process described herein for a multiplicity of field-emission devices on the same substrate, while providing various interconnections among them. An integrated array of field-emission devices made in accordance with the present invention has each device made as described herein, and the devices are arranged as cells containing at least one emitter and at least one anode per cell. The cells are arranged along rows and columns, with the anodes interconnected along the columns for example, and the emitters interconnected along the rows.

There are many diverse uses for the field-emission device structure and fabrication process of this invention, especially in making flat panel displays for displaying images and for displaying character or graphic information with high resolution. It is expected that the type of flat panel display made with the device of this invention can replace many existing displays including liquid crystal displays, because of their lower manufacturing complexity and cost, lower power consumption, higher brightness, and improved range of viewing angles. Displays made in accordance with the present invention are also expected to be used in new applications such as displays for virtual reality systems. In embodiments using substantially transparent substrates and films, displays incorporating the structures of the present invention are especially useful for augmented-reality displays.

Other embodiments of the invention will be apparent to those skilled in the art from a consideration of this specification or from practice of the invention disclosed herein. For example the order of process steps may be varied to some extent for various purposes; improved lithographic patterning, deposition, etching, or other process techniques may be used; functionally equivalent materials may be substituted for the particular materials used in the embodiments described herein; preferred dimensions may be varied; and other modifications may be made to adapt the device to various usages and conditions. It is intended that the specification and examples be considered as exemplary only, with the true scope and spirit of the invention being defined by the following claims.

Having described my invention, I claim:

1. A process for forming an evacuated chamber in a substrate having an upper surface, comprising the steps of:

(a) providing a first opening in said upper surface of the substrate, said opening having a first predetermined depth and a predetermined volume, to form a main cavity;

(b) providing a second opening, communicating with said first opening provided in step (a), said second opening having a second predetermined depth;

(c) temporarily filling both said first and second openings with a sacrificial first material;

(d) planarizing said sacrificial first material to form a planar surface;

(e) disposing a second material over said upper surface of the substrate and said planar surface to form a chamber ceiling;

(f) providing a third opening in said chamber ceiling only over said second opening;

(g) removing said sacrificial first material from beneath said chamber ceiling through said third opening to form a chamber;

(h) removing any atmosphere surrounding and within said chamber formed in step (g) to evacuate said chamber;

(i) introducing a gettering material into said third opening; and (j) then immediately introducing a third material into said second and third openings, while plugging said third opening and while sealing said third material to said second material, thereby enclosing said evacuated chamber.

2. A process as recited in claim 1, wherein said first-opening-providing step (a) is performed by directionally etching said upper surface of the substrate.

3. A process as recited in claim 1, wherein said first-opening-providing step (a) is performed by reactive ion etching of said upper surface of the substrate.

4. A process as recited in claim 1, wherein said second-opening-providing step (b) is performed by controlling said second predetermined depth to be less than said first predetermined depth of said first opening.

5. A process as recited in claim 1, wherein said temporarily-filling step (c) is performed by depositing an organic material as said sacrificial first material.

6. A process as recited in claim 1, wherein said temporarily-filling step (c) is performed by depositing parylene as said sacrificial first material.

7. A process as recited in claim 1, wherein said second-material-disposing step (e) is performed by disposing an inorganic material.

8. A process as recited in claim 1, wherein said sacrificial-first-material-removing step (g) is performed by isotropically etching said sacrificial first material.

9. A process as recited in claim 1, wherein said sacrificial-first-material-removing step (g) is performed by etching said sacrificial first material with oxygen plasma.

10. A process as recited in claim 1, wherein said third-material-introducing step (j) is performed by sputter-depositing said third material.

11. A process as recited in claim 1, wherein said third-material-introducing step (j) is performed by sputter-depositing an inorganic material.

12. A process as recited in claim 1, wherein said gettering-material-introducing step (i) comprises introducing an inorganic gettering material into at least said third opening.

13. A process as recited in claim 1, wherein said gettering-material-introducing step (i) comprises introducing a material selected from materials suitable for gettering oxygen and materials suitable for gettering gases containing sulfur.

14. A process as recited in claim 1, wherein said gettering-material-introducing step (i) comprises introducing a material selected from the list consisting of Ca, Ba, Ti, alloys of Th, and compounds, mixtures, and solutions thereof.

15. A process for forming a gas-filled chamber in a substrate having an upper surface, comprising the steps of:

(a) providing a first opening in said upper surface of the substrate, said opening having a first predetermined depth and a predetermined volume, to form a main cavity;

(b) providing a second opening, communicating with said first opening provided in step (a), said second opening having a second predetermined depth;

(c) temporarily filling both said first and second openings with a sacrificial first material;

(d) planarizing said sacrificial first material to form a planar surface;

(e) disposing a second material over said upper surface of the substrate and said planar surface to form a chamber ceiling;

(f) providing a third opening in said chamber ceiling only over said second opening;

(g) removing said sacrificial first material from beneath said chamber ceiling through said third opening to form a chamber;

(h) removing any atmosphere surrounding and within said chamber formed in step (g) to evacuate said chamber;

(i) introducing said gas at a desired pressure into the chamber;

(j) introducing a gettering material into said third opening, and (k) then immediately introducing a third material into said second and third openings, while plugging said third opening and while sealing said third material to said second material, thereby enclosing said gas-filled chamber.

16. A process as recited in claim 15, wherein said gas-introducing step (i) is performed by introducing an inert gas.

17. A process as recited in claim 15, wherein said first-opening-providing step (a) is performed by directionally etching said upper surface of the substrate.

18. A process as recited in claim 15, wherein said first-opening-providing step (a) is performed by reactive ion etching of said upper surface of the substrate.

19. A process as recited in claim 15, wherein said second-opening-providing step (b) is performed by controlling said second predetermined depth to be less than said first predetermined depth of said first opening.

20. A process as recited in claim 15, wherein said temporarily-filling step (c) is performed by depositing an organic material as said sacrificial first material.

21. A process as recited in claim 15, wherein said temporarily-filling step (c) is performed by depositing parylene as said sacrificial first material.

22. A process as recited in claim 15, wherein said second-material-disposing step (e) is performed by disposing an inorganic material.

23. A process as recited in claim 15, wherein said sacrificial-first-material-removing step (g) is performed by isotropically etching said sacrificial first material.

24. A process as recited in claim 15, whereto said sacrificial-first-material-removing step (g) is performed by etching said sacrificial first material with oxygen plasma.

25. A process as recited in claim 15, wherein said third-material-introducing step (j) is performed by sputter-depositing said third material.

26. A process as recited in claim 15, wherein stud third-material-introducing step (j) is performed by sputter-depositing an inorganic material.

27. A process as recited in claim 15, wherein said gettering-material-introducing step (i) comprises introducing an inorganic gettering material into at least said third opening.

28. A process as recited in claim 15, wherein said gettering-material-introducing step (i) comprises introducing a material selected from materials suitable for gettering oxygen and materials suitable for gettering gashes containing sulfur.

29. A process as recited in claim 15, wherein said gettering-material-introducing step (i) comprises introducing a material selected from the list consisting of Ca, Ba, Ti, alloys of Th, and compounds, mixtures, and solutions thereof.

* * * * *